US011117060B2

(12) United States Patent
Sall et al.

(10) Patent No.: US 11,117,060 B2
(45) Date of Patent: Sep. 14, 2021

(54) SPINNING RAFT RIDE

(71) Applicant: Whitewater West Industries, Ltd., Richmond (CA)

(72) Inventors: Kelly Sall, Richmond (CA); Shane Jensen, Richmond (CA); Tim Lennox, Richmond (CA)

(73) Assignee: WHITEWATER WEST INDUSTRIES, LTD.

( * ) Notice: Subject to any disclaimer, the term of this patent is extended or adjusted under 35 U.S.C. 154(b) by 0 days.

(21) Appl. No.: 16/431,585

(22) Filed: Jun. 4, 2019

(65) Prior Publication Data

US 2019/0366224 A1 Dec. 5, 2019

Related U.S. Application Data

(60) Provisional application No. 62/680,565, filed on Jun. 4, 2018.

(51) Int. Cl.
*A63G 3/02* (2006.01)
*A63G 21/18* (2006.01)

(52) U.S. Cl.
CPC ..... *A63G 3/02* (2013.01); *A63G 21/18* (2013.01)

(58) Field of Classification Search
CPC . A63G 3/00; A63G 3/02; A63G 21/00; A63G 21/18; A63G 31/007; B60L 13/00; B60L 13/04; B60L 13/10
USPC ..... 472/13, 117, 128–129; 104/281, 283
See application file for complete search history.

(56) References Cited

U.S. PATENT DOCUMENTS

| | | | | |
|---|---|---|---|---|
| 1,607,771 | A | 11/1926 | Miller | |
| 3,438,074 | A * | 4/1969 | Goyen | B63B 5/24 114/357 |
| 3,497,211 | A | 2/1970 | Nagin | |
| 3,830,161 | A | 8/1974 | Bacon | |
| 3,871,042 | A | 3/1975 | Farmer | |
| 4,145,042 | A | 3/1979 | Becker et al. | |
| 4,149,710 | A | 4/1979 | Rouchard | |

(Continued)

FOREIGN PATENT DOCUMENTS

| | | |
|---|---|---|
| EP | 0921845 | 6/1999 |
| JP | 2000514330 | 10/2000 |
| WO | 9801199 | 1/1998 |

OTHER PUBLICATIONS

The Ultimate Spinning Rapids Water Ride Experience, https://www.whitewaterwest.com/en/products/water-rides/spinning-rapids-ride/ ,Webpage captured Feb. 13, 2020.

*Primary Examiner* — Kien T Nguyen
(74) *Attorney, Agent, or Firm* — Buchalter, a professional corporation; Kari L. Barnes

(57) ABSTRACT

A water ride includes a ride surface defining a ride path. Users of the water ride travel in ride vehicles along the ride surface with the ride vehicles traveling upon a layer of water introduced into or onto the ride surface. To induce the ride vehicles to change orientation at desired locations along the ride surface, the ride vehicles each include one or more ride vehicle components located on or near a bottom surface of the ride vehicle. One or more ride surface components are positioned at desired locations along the ride path in position to make contact with the ride vehicle component(s). This contact or interaction between the ride vehicle component(s) and the ride surface component(s) causes a change in orientation, such as a spin, to the ride vehicle.

17 Claims, 6 Drawing Sheets

(56) References Cited

U.S. PATENT DOCUMENTS

| | | | | | |
|---|---|---|---|---|---|
| 4,194,733 | A | | 3/1980 | Whitehouse, Jr. | |
| 4,196,900 | A | | 4/1980 | Becker et al. | |
| 4,506,664 | A | | 3/1985 | Brault | |
| 4,805,897 | A | | 2/1989 | Dubeta | |
| 4,836,521 | A | | 6/1989 | Barber | |
| 4,984,783 | A | | 1/1991 | Fujimaki | |
| 5,011,134 | A | | 4/1991 | Langford | |
| 5,031,556 | A | * | 7/1991 | Blee | B63B 1/042 114/61.33 |
| 5,069,443 | A | | 12/1991 | Shiratori | |
| 5,194,048 | A | | 3/1993 | Briggs | |
| 5,213,547 | A | | 5/1993 | Lochtefeld | |
| 5,378,197 | A | | 1/1995 | Briggs | |
| 5,405,294 | A | | 4/1995 | Briggs | |
| 5,453,054 | A | | 9/1995 | Langford | |
| 5,685,778 | A | | 11/1997 | Sheldon et al. | |
| 5,716,282 | A | * | 2/1998 | Ring | A63G 3/00 104/70 |
| 6,006,672 | A | * | 12/1999 | Newfarmer | A63G 3/00 104/23.2 |
| 6,334,799 | B1 | | 1/2002 | Delpozo | |
| 6,375,578 | B1 | | 4/2002 | Briggs | |
| 6,527,646 | B1 | | 3/2003 | Briggs | |
| 6,871,368 | B2 | | 3/2005 | Calkin | |
| 7,059,252 | B2 | * | 6/2006 | Guardo, Jr. | B60L 13/10 104/281 |
| 7,758,435 | B2 | | 7/2010 | Henry et al. | |
| 7,905,790 | B2 | | 3/2011 | Schnuckle | |
| 7,950,333 | B2 | * | 5/2011 | Crawford | B60L 13/04 104/283 |
| 7,967,682 | B2 | | 6/2011 | Werner | |
| 7,967,692 | B2 | | 6/2011 | Wemer | |
| 8,079,916 | B2 | | 12/2011 | Henry | |
| 8,226,293 | B2 | | 7/2012 | Briggs | |
| 8,241,182 | B2 | | 8/2012 | Julskjaer | |
| D693,741 | S | | 11/2013 | Carrier | |
| 9,138,653 | B2 | | 9/2015 | Heaven | |
| 2007/0131155 | A1 | | 6/2007 | Dingel | |
| 2008/0014835 | A1 | | 1/2008 | Weston | |
| 2008/0064514 | A1 | | 3/2008 | Larsen | |
| 2008/0293470 | A1 | | 11/2008 | Proud | |
| 2014/0057524 | A1 | | 2/2014 | Teel | |
| 2014/0135137 | A1 | | 5/2014 | Heaven | |

* cited by examiner

SPINNING RAFT RIDE

CROSS REFERENCE TO RELATED APPLICATIONS

This application claims the benefit of U.S. Provisional Patent Application Ser. No. 62/680,565, filed on Jun. 4, 2018, entitled "SPINNING RAFT RIDE," which is hereby incorporated by reference in its entirety into this application.

BACKGROUND

Field of the Invention

The present invention relates to a method, system, and/or apparatus for entertaining users in an amusement ride. More particularly, the present invention relates to a method, system, or apparatus for changing an orientation or behavior of a ride vehicle in an amusement ride during traversal of the amusement ride.

Description of the Related Art

Amusement attractions, such as water rides or waterslides, have become a popular entertainment activity around the world. In one type of conventional water ride, users sit in a ride vehicle, such as a rectangular, oval, or generally circular ride vehicle, and the ride vehicle travels along a path defined by a flume or other ride surface. The flume or other ride surface may slope downwardly and include various bends and turns, with water running along a bottom surface of the flume or along the ride surface.

Such conventional water rides may, however, become monotonous when used repeatedly by a rider (or riders) over a period of time. The flume or ride surface path is fixed and cannot be changed readily to provide any different sensations to users of the ride. Accordingly, the ride vehicles and the users thereon therefore generally along the same path each ride. Moreover, such conventional water rides also tend to maintain the ride vehicles in the same or substantially similar orientation while traveling along the water ride. Thus, the ride vehicles may tend to rub up against the flume surfaces at the same points, producing an uneven wear pattern on the ride vehicles outer surfaces. This uneven wear can require more frequent reparations to those areas of the outer surface and/or require replacement of ride vehicles even when the majority of the ride vehicle's construction would not warrant any replacement.

Some conventional water rides do offer a change in orientation of a user while the user traverses the ride on a ride vehicle by allowing the user to spin the ride vehicle through contact between the side of the ride vehicle and a substantially vertical wall of the flume or other ride surface. However, this method of attempting to induce a spin to the ride vehicle requires hard contact (e.g., bumping or impact) between the ride vehicle and the substantially vertical wall. Such hard contact may potentially cause damage to the ride vehicle and may produce a less enjoyable and/or more difficult or jolting ride experience for users.

Alternatively, other conventional water rides may offer a flume or other ride surface configuration having a structural feature such as a sloped surface, step, or ridge that extends longitudinally along one side of the flume or other ride surface configuration in order to help change the orientation of the ride vehicle. These longitudinally extending features are intended to induce spin to the ride vehicle when one side of the ride vehicle rides up over the particular feature.

However, this conventional implementation has several problems. The structural feature may not consistently and/or effectively induce a desired spin to the ride vehicle or may not be changed/modified based upon the particular configuration of the flume or other ride surface. Thus, the water ride remains generally the same time after time.

U.S. Pat. No. 5,716,282 discloses a water ride in which a ride vehicle traveling along a flume on a thin layer of water is induced to spin at desired locations through features located on a bottom surface of the ride vehicle interacting with features of the flume. The features of the flume may be mats positioned on the flume surface to engage with one or more features of the ride vehicle and therefore induce the ride vehicle to spin. One potential issue, however, is that the engagement may potentially create undesirable contact (e.g., abrupt and/or destructive) between the ride vehicle and flume that can jar the users, unnecessarily slow the ride vehicle, and/or damage features of the ride vehicle and/or the flume such as by disengaging one or more features from the flume or the ride vehicle.

Accordingly, an improved method, system, and or apparatus is desired for addressing one or more of the problems identified above and/or to aid in permitting a user and/or a ride vehicle to change its orientation or behavior during traversal of an amusement attraction, such as a water ride.

SUMMARY

A ride vehicle, such as a raft (e.g., inflatable, partially inflatable, rigid, etc.), for an amusement ride, such as a water ride (e.g., waterslide) may include one or more ride vehicle components or raft features on a surface of or connected with the ride vehicle, and a ride surface or structure, such as a flume (e.g., open-flume, closed-flume, etc.), may include one or more ride surface components or flume features at one or more points along a ride path of the flume. Contact between the ride vehicle components or ride vehicle features or components and the ride surface or ride surface components features as the ride vehicle travels along the ride surface may cause the ride vehicle to alter its behavior, for example, to spin in a controlled or desired fashion.

The ride vehicle components or features may be separate from the body of the ride vehicle and then coupled to the body of the ride vehicle. The body of the ride vehicle may include one or more recesses, such that the ride vehicle components or features may be placed into the one or more recesses. Alternatively, or in addition thereto, the ride vehicle may include a flanged edge. The flanged edges and/or recesses may hide corners and edges of the ride vehicle features therein, such that the corners and/or peripheral edges of the ride vehicle components or features may not contact the ride surface or flume (or particular portions of the ride surface or flame) or the ride surface corresponding components or features. The recesses and/or flanged edges may permit the flume features to run across an integrated or continuous surface of the ride vehicle before contacting the ride surface components or ride vehicle features without having to contact a different supporting surface of the ride vehicle components or ride vehicle features. The ride vehicle components or features may also be integrated and/or directly formed on the ride vehicle surface.

The ride surface (e.g., flume) components or features may be separately formed and then coupled to the ride surface. The body of the ride surface may include one or more recesses, such that the ride surface components or features may be placed into the recesses. Alternatively, or in addition thereto, the ride surface may include a flanged edge. The flanged edges and/or recesses may hide corners and peripheral edges of the ride surface components or features therein, such that the corners and/or peripheral edges of the ride surface components or features may not contact the ride vehicle or the ride vehicle components or features. The recesses and/or flanged edges may permit the ride vehicle components or features to run across an integrated or continuous ride surface before contacting the ride surface components or features without having to contact a different supporting surface of the ride surface components or features. The ride surface components or features may also be integrated and/or directly formed on the ride surface. In certain embodiments, a separate covering or layer may also be added to either the ride vehicle or ride surface to create or define the flanged edges that overlap base edges or peripheral edges of the ride surface or ride vehicle components.

Exemplary embodiments may also include ride surface and/or ride vehicle features of varying height and/or configuration or profile such that the contact between ride surface and ride vehicle components or features and/or effect on the changing the behavior or orientation of the ride vehicle within or upon the ride surface may be better controlled. Exemplary embodiments described herein include devices and methods for changing an orientation or behavior of a ride vehicle in a flume. The ride according to the disclosure may include a ride surface that may follow or define a ride path and may have a layer of water running along a bottom of the ride surface. The ride vehicle may be any suitable shape.

In one embodiment, an amusement ride may include a ride surface having a recess therein, a ride surface component disposed at least partially within the recess of the ride surface, and a ride vehicle configured to travel along the ride surface, the ride vehicle having at least one protrusion extending therefrom. The at least one protrusion of the ride vehicle may be configured to make contact with the ride surface component causing a change in behavior of the ride vehicle.

In another embodiment, a water ride may include a ride surface having a recess therein, a ride surface component connected within the recess of the ride surface, a ride vehicle configured to travel along the ride surface, and a ride vehicle component connected with the ride vehicle. A change in behavior of the ride vehicle may be caused by a non-frictional force between the ride vehicle component and the ride surface component.

In another embodiment, a ride vehicle for an amusement attraction may include a bottom surface and a plurality of protrusions connected with the bottom surface. The plurality of protrusions may be configured to engage with a component associated the amusement attraction to cause a gradually increasing application of force applied upon the ride vehicle for changing a behavior of the ride vehicle, These and other objects, advantages, and features of the disclosure will be apparent from the following description of the preferred embodiments, considered along with the accompanying drawings. This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further purposes and advantages, will be better understood from the following description when considered in connection with the accompanying figures. It is to be expressly understood, however, that each of the figures is provided for the purposes of illustration and description only and is not intended as a definition of the limits of the present disclosure.

DETAILED DESCRIPTION

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. It will be apparent to those skilled in the art, however, that these concepts may be practiced without these specific details. In some instances, structures and/or components are shown in block diagram form in order to avoid obscuring such concepts. As described herein, the use of the term "and/or" is intended to represent an "inclusive OR", and the use of the term "or" is intended to represent an "exclusive OR".

The following detailed description illustrates by way of example, not by way of limitation, the principles of the disclosure. This description will clearly enable one skilled in the art to make and use the disclosed embodiments, and describes several embodiments, adaptations, variations, alternatives and uses of the disclosure, including what is presently believed to be the best mode of carrying out the disclosure. It should be understood that the drawings are diagrammatic and schematic representations of exemplary embodiments of the disclosure, and are not limiting of the present embodiments nor are they necessarily drawn to scale.

Figure 1:
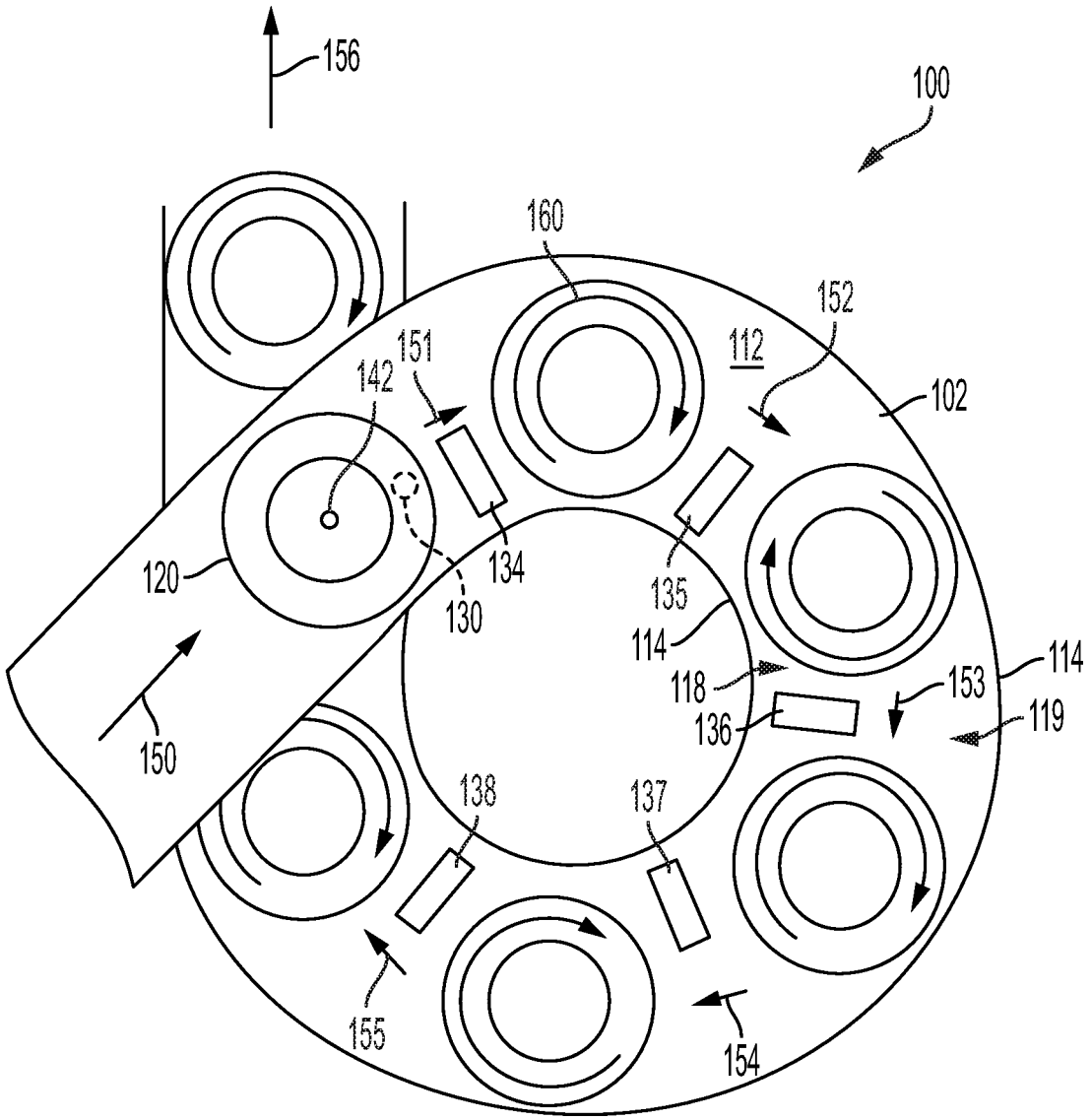
FIG. 1 illustrates a top view of a portion of a water ride and a ride vehicle during a plurality of stages of travel along the water ride embodying one or more principles of the disclosure, according to one exemplary embodiment of the invention.

FIG. 1 shows a top view of a portion of a water ride 100. The water ride 100 may include a ride surface 102 (e.g., a flume) that may extend along a predefined (e.g., circuitous) course to define a ride path, for example as identified by the arrows (150, 151, 152, 153, 154, 155, 156). The ride surface 102 may be constructed of a plurality of sections (not shown) that may be connected end to end to make the desired ride path, for example with straight sections and curves. In one embodiment, one or more of the plurality of sections and/or the ride surface 102 may be made from fiberglass. In one embodiment, one or more of the plurality of sections and/or the ride surface 102 may be connected together by flanges formed on or connected with the sections. The ride surface 102 may include a bottom surface 112 and one or more sidewalls 114. As shown in more detail in FIGS. 2A-C, a layer or flow of water may be provided upon the bottom surface 112 of the ride surface 102, between the one or more sidewalls 114. The ride surface 102 may include one or more bends or curves, each bend or curve having an inside section 118 and an outside section 119.

The water ride 100 may also include a ride vehicle 120 configured to travel along the ride surface 102 of the water ride 100 substantially in the direction of the arrows (150, 151, 152, 153, 154, 155, 156), for example, upon or with the layer or flow of water. Users may be seated or otherwise fully or partially contained within or upon the ride vehicle 120 during travel along the water ride 100. The ride vehicle 120 may be fully or partially inflatable, and/or may have configurations such as, but not limited to, circular, square, rectangular, hexagonal, octagonal, etc. and/or any combination thereof. In one embodiment, the ride vehicle 120 may include inflatable portions (e.g., sides) sides, with a layer of material connected to or at a bottom of the ride vehicle 120 and forming a floor and/or bottom surface of the ride vehicle 120. Although the ride vehicle 120 may be inflatable, in alternative embodiments, the ride vehicle 120 may be non-inflatable (e.g., manufactured of foam) and/or any combination thereof. The ride vehicle 120 may have one or more seats or surfaces coupled with an upper surface of the ride vehicle 120 such that a user may be permitted to sit upon the seat or surface and be positioned a distance away from water flowing upon the ride surface 102 of the water ride 100.

The water ride 100 may begin at an elevated section of the ride surface 102 (such elevated section not shown in FIG. 1) where one or more users may enter the ride vehicle 120 and the ride vehicle 120 may be released onto the ride surface 102. Water injected onto the ride surface 102 may flow along the bottom portion 112 of the ride surface 102. The water may flow or be caused to travel via gravity and/or other elements (e.g., water jets) so that it substantially follows and/or defines the ride path for the water ride 100. In one embodiment, the ride path for the water ride 100 may travel from the elevated section to a bottom section (e.g., run-out, pool, etc.) (not shown) where some or all of the water the water is substantially collected and/or recirculated to the elevated section to again be injected onto the ride surface 102. The ride surface 102 and/or injected water may define any of a variety of possible paths, for example, including uphill sections in which water is pumped uphill to propel the ride vehicle 120 in the desired direction, twists, turns, etc. The ride vehicle 120 may exit the ride surface 102 into the bottom section and travel to an unloading area (not shown) where users may disembark from the ride vehicle 120. The ride vehicle 120 may then be loaded on a lifting system (not shown) or other device and may be lifted again to the elevated section for a subsequent traversal down the ride surface 102. In certain embodiments, a user may be permitted to take the ride vehicle 120 with them after disembarking from the ride vehicle 120.

The water ride 100 is configured to cause changes in orientation or behavior to the ride vehicle 120 via interaction between components associated with the ride vehicle 120 and components associated with the ride surface 102, as discussed in greater detail herein. As the ride vehicle 120 travels along the ride surface 102 of the water ride 100, for example, in the direction of arrows (150, 151, 152, 153, 154, 155, 156), one or more ride vehicle components 130 may make contact with one or more ride surface components (134, 135, 136, 137, 138) as the ride vehicle 120 passes thereby or thereover. For example, as shown in FIG. 1, the ride vehicle component 130 may be disposed at a location along a bottom surface of the ride vehicle 120 and the ride surface component 134 may be disposed at a location along the ride surface 102. When the ride vehicle component 130 makes contact or otherwise engages or interacts with the ride surface component 134, such contact, engagement, and/or interaction causes a force to be applied to the ride vehicle 120 at the location of the ride vehicle component 130. The contact may be such that the force is gradually imposed or transitionally imposed upon the ride vehicle 120 via the ride vehicle component 130, rather than the force being abruptly applied, or it may be applied universally, rather than gradually or transitionally.

The contact, engagement, or interaction between the ride vehicle component 130 and the ride surface component 134 may cause the ride vehicle 120 to slow at a point at which the contact, engagement, or interaction is made. Since the ride vehicle component 130 may be offset from a center of the ride vehicle 120, and/or since the ride surface component 134 may extend along one side of the ride surface 102, the contact between the ride vehicle component 130 and the ride surface component 134 may be offset from a center of rotation 142 of the ride vehicle 120. Thus, the contact, engagement, or interaction may apply a force to the ride vehicle that is offset from the ride vehicle's 120 center of rotation. Accordingly, this may cause a side of the ride vehicle 120 opposite a side on which contact is made to travel at a speed higher than the side upon which the contact is made, and the ride vehicle 120 may therefore spin in the direction shown by arrow 160 in FIG. 1. The spin may be counter-clockwise when the contact between ride vehicle component 130 and the ride surface component 134 is on a left side of the ride vehicle 120 traveling along the ride direction, and may be clockwise (e.g., as shown) when the contact is on a right side of the ride vehicle 120. The ride vehicle component 130 and the ride surface component 134 may engage, interact, cooperate, contact, or otherwise interact with one another to produce the force described to cause an orientation or behavior change in the ride vehicle 120 by any of a variety of possible manners (e.g., increased or reduced frictional surfaces, raised surfaces such as protrusions, depressed surfaces such as recessions, bristles, ridges, adhesives, water, air, magnetic, etc.).

As shown in the FIG. 1, the ride surface component 134 may be configured or disposed on the ride surface 102 such that it extends across a portion of the ride surface 102 transversely to the ride path in that area of the ride surface 102. In another embodiment, the ride surface component 134 may be configured or disposed on or connected with the ride surface 102 in alternative manners (e.g., extending across an entire length or width of the ride surface 102).

As further shown in FIG. 1, additional multiple ride surface components (135, 136, 137, 138) may be disposed or located along the ride surface 102 at different locations to induce spinning, helping to continue a spin, stopping a spin, etc. as desired. In one example, when a spin or other change in orientation is desired to begin, such spin or change in orientation may be induced along a curved portion of the ride surface 102, with the ride surface component located at an inside section 118 of the ride surface 102. The additional multiple ride surface components (135, 136, 137, 138) along a length of the ride surface 102 may produce a complete 360 degree spin of the ride vehicle 120 about the center of rotation 142 of the ride vehicle 120 whereas a single ride surface component 124 in a certain area may produce only a partial spin of the ride vehicle 120. The orientation or spin of the ride vehicle 120 may be made without any or without substantial bumping between the sidewalls 114 of the ride surface 102 and the ride vehicle 120.

In certain embodiments, the ride vehicle component 130 may be a separate component that is, fastened, coupled, affixed, adhered, or otherwise connected with the ride vehicle 120. In certain embodiments, the ride surface component 134 may be a separate component that is, fastened, coupled, affixed, adhered, or otherwise connected with the ride surface 102. Accordingly, existing or conventional rides may be modified or retrofitted to include such one or more ride vehicle components 130 and/or ride surface components 134. The ride vehicle component 130 and/or ride surface component 134 may be connected to their respective surfaces by any of a variety of possible ways, including, but not limited to, buttons, nails, snaps, screws, adhesives, retaining frame, welds, etc. and/or any combination thereof.

In an alternative embodiment, a particular ride vehicle 120 and/or ride surface 102 may have such components integrally formed therein. In one embodiment, the ride vehicle component 130 and/or ride surface component 134 may be configured to change its position and/or configuration along the ride vehicle 120 and/or ride surface 102, respectively. The ride vehicle component 130 and/or ride surface component 134 may be configured to be switched from position to position (e.g., manually and/or automatically, such as via a connected electronic or computer system). The ride vehicle component 130 and/or ride surface component 134 in different positions may cause the ride vehicle 120 to spin, behave, or orient differently, producing different sensations to users and helping prevent the water ride 100 from becoming monotonous over time. Any of a variety of desired spins, partial spins, or other orientations of the ride vehicle 120 may be accommodated through the placement of one or more ride surface components and/or one or more ride vehicle components that cooperate to cause rotation or orientation or behavior change of the ride vehicle 120. In certain embodiments, any and/or all of the ride surface components (134, 135, 136, 137, 138) may be made of a material that allows for a tread or other pattern to be implanted therein or thereon. For example, in one embodiment, any or all of the ride surface components (134, 135, 136, 137, 138) may be a mat having depressions and/or ridges configured to engage or otherwise interact with protrusions of the ride vehicle component 130 and additionally, alternatively, or such ridges may for formed so as to, contain a tread or pattern thereon that helps encourage removal of water from a surface of the ride surface component in an effort to reduce undesirable impact that the presence of water or other fluid may have in the interaction between the ride vehicle component 130 and the any or all of the ride surface components (134, 135, 136, 137, 138).

Figure 2A:
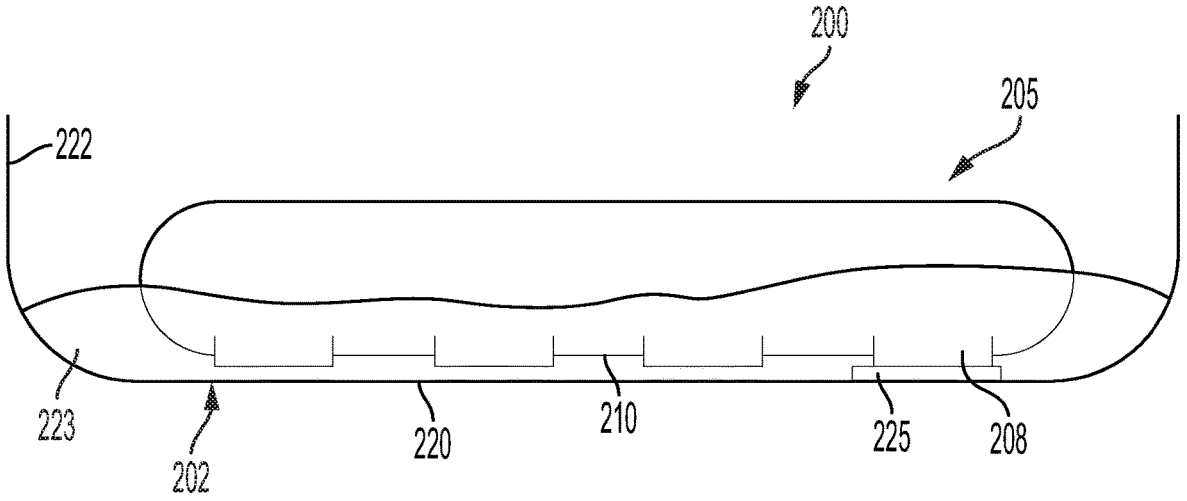
FIG. 2A illustrates a side view of a ride vehicle upon a ride surface embodying one or more principles of the disclosure, according to exemplary embodiments of the invention.
Figure 2B:
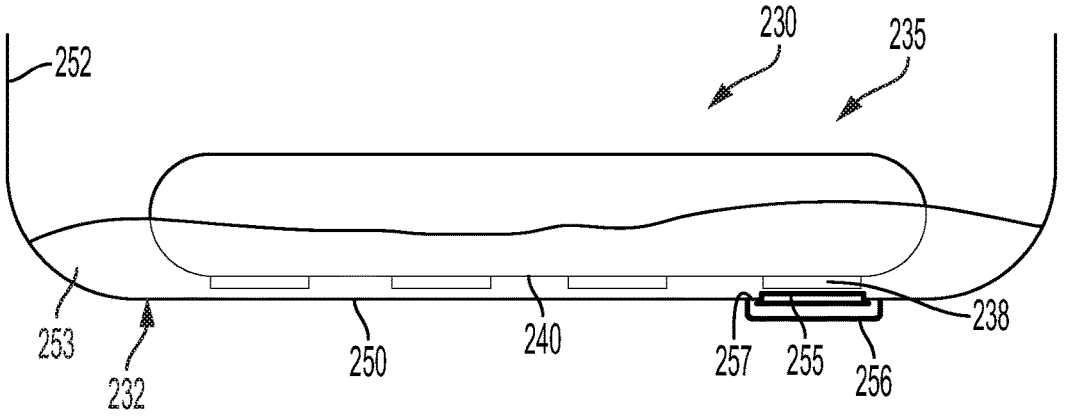
FIG. 2B illustrates a side view of a ride vehicle upon a ride surface embodying one or more principles of the disclosure, according to exemplary embodiments of the invention.
Figure 2C:
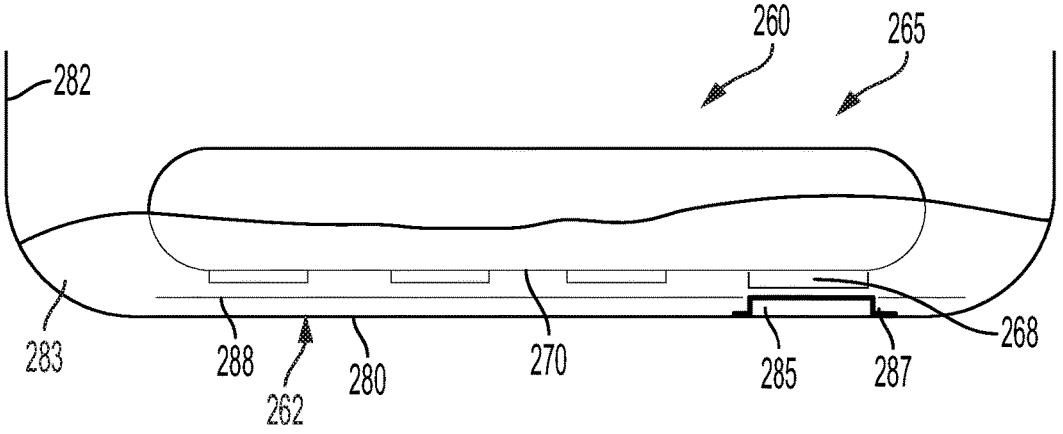
FIG. 2C illustrates a side view of a ride vehicle upon a ride surface embodying one or more principles of the disclosure, according to exemplary embodiments of the invention.

FIGS. 2A-2C show side views (200, 230, 260) of various ride vehicles and ride surfaces whereby the ride vehicle may be caused to change its orientation or behavior based upon orientation components associated with the ride vehicles and/or ride surfaces. Certain features of the ride vehicle and/or ride surface and/or their associated orientation components may be the same as or similar to those previously discussed, for example, ride vehicle 120, ride surface 102, ride vehicle component 130, and ride surface component 134 of FIG. 1. Each of FIGS. 2A-2C illustrate differing possible configurations for ride vehicle components and/or ride surface components.

FIG. 2A shows a side view 200 of a ride vehicle 205 and having a plurality of integrally formed protrusions making up one or more ride vehicle components 208 located on or near the bottom of the ride vehicle 205. The ride vehicle components 208 may extend a distance lower than a bottom surface 210 of the ride vehicle 205. The ride vehicle 205 is configured to ride or travel along a ride surface 202 (e.g., a flume) that may include a bottom surface or floor 220 and one or more sidewalls 222. A flow of water 223 may be disposed within the sidewalls 222 and upon the bottom surface or floor 220 of the ride surface 202.

The ride surface 202 includes a ride surface component 225 that is positioned on or adjacent to the bottom surface or floor 220 of the ride surface 202. As shown, the ride surface component 225 may be connected with the bottom surface or floor 220 of the ride surface 202 (e.g., via bolts, screws, etc.) such that it extends a height above the bottom surface or floor 220 of the ride surface 202. In one embodiment, the ride surface component 225 may be integrally formed with the ride surface 202. Any of a variety of possible manners of connecting the ride surface component 225 with the ride surface 202 may be used in alternative embodiments. The ride vehicle components 208 and the ride surface component 225 are configured to engage or otherwise interact with one another (e.g., via frictional contact, magnetic force, etc.) such that a force is applied at the location of the ride vehicle component 208 that engages or interacts with the ride surface component 225 in order to impart a change in behavior or orientation (e.g., a spin) of the ride vehicle 205, the same or similar to previous discussions. Alternative placement of either the ride vehicle components 208 and/or the ride surface component 225 may desirably result in different types or manners of orientation or behavior change for the ride vehicle 205.

FIG. 2B similarly shows a side view 230 of a ride vehicle 235. Contrary to FIG. 2A, instead of having integrally formed protrusions, the ride vehicle 235 includes a plurality of separately formed, but attached, protrusions making up one or more ride vehicle components 238 located on or near the bottom of the ride vehicle 235. In one embodiment, one or more of the ride vehicle components 238 may be configured to selectively project and/or be enabled, such as via providing power to a circuit or other element, (e.g., automatically based upon sensing a proximity of a cooperating ride surface component, automatically based upon time elapsed from start of ride or other known checkpoint, manually based on rider feedback, such as via a button or other control or manner of obtaining a rider's desires, etc.) to change the behavior or orientation of the ride vehicle 235. The ride vehicle components 238 may extend a distance lower than a bottom surface 240 of the ride vehicle 235. The ride vehicle components 238 may be attached to the ride vehicle in any of a variety of manners, for example, adhesives, welding, sewing or inclusion within a pocket of material, bolted, screwed, etc. In one embodiment, the ride vehicle components 238 may be a coating applied to the bottom surface 240 of the ride vehicle 235. In one embodiment, the ride vehicle components 238 may be integrally formed with the ride vehicle 235. The ride vehicle 235 is configured to ride or travel along a ride surface 232 (e.g., a flume) that may include a bottom surface or floor 250 and one or more sidewalls 252. A flow of water 253 may be disposed within the sidewalls 252 and upon the bottom surface or floor 250 of the ride surface 232.

The ride surface 232 includes a ride surface component 255 that is positioned on or adjacent to the bottom surface or floor 250 of the ride surface 232. As shown, the ride surface 232 may include a recess 256 that is configured to contain all or some of the ride surface component 255. The recess 256 may include a lip 257 (e.g., a flanged lip) in which the peripheral edge of the bottom surface or floor of the ride surface 232 that is adjacent to the recess 256 further protected. The lip 257 may prevent or reduce contact between the ride vehicle component 238 and the ride surface component 255. For example, the lip 257 may apply a force to help retain the ride surface component 255 upon the ride surface 232 upon contact between the ride surface component 255 and the ride vehicle component 238. The lip 257 may be integrated into the ride surface 232 and/or removably connected therewith. The lip 257 may be used in conjunction with the recess 256 or by itself, directly with a flat ride surface 232. For example, the lip 257 may be a similar to a rigid structure or frame that can cover and/or help secure the ride surface component 255 to the ride surface 232.

The ride surface component 255 may be connected with the ride surface 232 within the recess 256 (e.g., via bolts, screws, etc.) such that it extends a height above the bottom surface or floor 250 of the ride surface 232 (e.g., extends above the plane or depth of the recess 256). In an alternative embodiment, the ride surface component 255 may be configured to sit in the recess 256 such that it is flush with the bottom surface or floor 250 of the ride surface 232.

In still another embodiment, the ride surface component 255 may be configured to sit in the recess 256 such that it is below the plane of the bottom surface or floor 250 of the ride surface 232. In such an embodiment, only the ride vehicle component 238 may be configured to make contact with the ride surface component 255 since the ride vehicle 235 will travel substantially upon the bottom surface or floor 250 of the ride surface 232 and only the ride vehicle component 238 extends a downward distance long enough to make contact with the ride surface component 255 sitting within the recess 256 and below the bottom surface or floor 250 of the ride surface 232. Such a configuration may help avoid wear-and-tear upon the ride vehicle 235, the ride surface 232, the ride vehicle component 238, and/or the ride surface component 255.

Any of a variety of possible manners of connecting the ride surface component 255 with the ride surface 232 may be used in alternative embodiments. The ride vehicle components 238 and the ride surface component 255 are configured to engage or otherwise interact with one another (e.g., via frictional contact, magnetic force, etc.) such that a force is applied at the location of the ride vehicle component 238 that engages or interacts with the ride surface component 255 in order to impart a change in behavior or orientation (e.g., a spin) of the ride vehicle 235, the same or similar to previous discussions. Alternative placement of either the ride vehicle components 238 and/or the ride surface component 255 may desirably result in different types or manners of orientation change for the ride vehicle 235.

FIG. 2C similarly shows a side view 260 of a ride vehicle 265. Like FIG. 2B, the ride vehicle 265 includes a plurality of separately formed, but attached, protrusions making up one or more ride vehicle components 268 located on or near the bottom of the ride vehicle 265. In one embodiment, one or more of the ride vehicle components 268 may be configured to selectively project and/or be enabled, such as via providing power to a circuit or other element, (e.g., automatically based upon sensing a proximity of a cooperating ride surface component, automatically based upon time elapsed from start of ride or other known checkpoint, manually based on rider feedback, such as via a button or other control or manner of obtaining a rider's desires, etc.) to change the behavior or orientation of the ride vehicle 265. The ride vehicle components 268 may extend a distance lower than a bottom surface 270 of the ride vehicle 265. The ride vehicle components 268 may be attached to the ride vehicle in any of a variety of manners, for example, adhesives, welding, sewing or inclusion within a pocket of material, bolted, screwed, etc. The ride vehicle 265 is configured to ride or travel along a ride surface 262 (e.g., a flume) that may include a bottom surface or floor 280 and one or more sidewalls 282. A flow of water 283 may be disposed within the sidewalls 282 and upon the bottom surface or floor 280 of the ride surface 262.

The ride surface 262 includes a ride surface component 285 that is positioned on or adjacent to the bottom surface or floor 280 of the ride surface 262. As shown, the ride surface component 285 may be connected with the bottom surface or floor 280 of the ride surface 262 (e.g., via bolts, screws, etc.) such that it extends a height above the bottom surface or floor 280 of the ride surface 262. Any of a variety of possible manners of connecting the ride surface component 285 with the ride surface 262 may be used in alternative embodiments. A cover 288 or other protective layer (e.g., material, structure, etc.) may be placed a distance away from the bottom surface or floor 280 of the ride surface 262. The cover 288 may overlap with a portion of the ride surface 262 and/or the ride surface component 285 and/or may extend across an entire, or partial, portion of the ride surface 262. The cover 288 may help reduce the height of an edge or lip 287 at the borders of the ride surface component 285. For example, by lowering the overall height of the edge of lip 287 that is experienced by the ride vehicle 265 when the ride vehicle component 268 engages with the ride surface component 285, due to the use of the cover 288, a reduction in wear-and-tear and/or jolting of the ride experience may be obtained. Although FIG. 2C illustrates the cover 288 as separated from the ride surface 262, in an alternative embodiment the cover 288 may be in direct contact with the ride surface 262 and/or may separate therefrom in order to accommodate all or part of the ride surface component 285.

The ride vehicle component 268 and the ride surface component 285 are configured to engage or otherwise interact with one another (e.g., via frictional contact, magnetic force, etc.) such that a force is applied at the location of the ride vehicle component 268 that engages or interacts with the ride surface component 285 in order to impart a change in orientation (e.g., a spin) of the ride vehicle 265, the same or similar to previous discussions. Alternative placement of either the ride vehicle components 268 and/or the ride surface component 285 may desirably result in different types or manners of orientation change for the ride vehicle 265.

Figure 3:
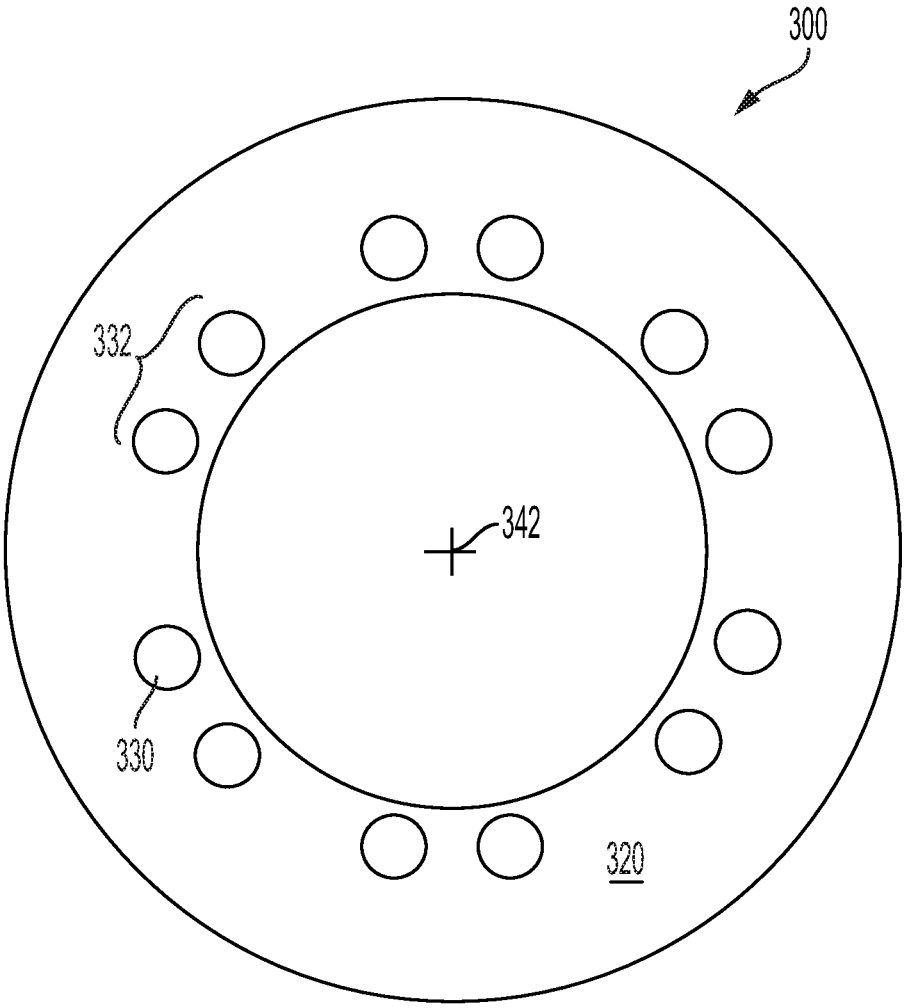
FIG. 3 illustrates a bottom view of a ride vehicle for an amusement ride embodying one or more principles of the disclosure, according to one exemplary embodiment of the invention.

FIG. 3 shows a bottom view of a ride vehicle 300 for a water ride. The ride vehicle 300 may include one or more features that are the same as or similar to those previously discussed. One or more ride vehicle components 330 may be disposed (e.g., connected with, adhered to, formed integrally with, etc.) on, adjacent, and/or along a bottom surface 320 of the ride vehicle 300, for example, to engage or otherwise interact with components of a ride surface to effect orientation change or other behavior of the ride vehicle 300, the same or similar as discussed throughout. In one embodiment, and as shown in FIG. 3, twelve ride vehicle components 330 may be used substantially about a periphery of the ride vehicle 300. The ride vehicle components may be offset from a center of the ride vehicle. Ride vehicle components 330 may be disposed in any of a variety of possible patterns, shapes, and/or configurations as desired.

For example, as shown, a plurality of paired groups 332 may be used and/or spaced in ring pattern along the bottom surface 320, as shown. The ride vehicle components 330 may be circular, rectangular, or any other desired shape or configuration. Greater or fewer ride vehicle components 330 may be used in an alternative embodiment. The one or more ride vehicle components 330 may be the same shape, size, and/or configuration as one another or the one or more ride vehicle components 330 may be shaped, sized, or configured differently from one another. As previously discussed, when one or more of the ride vehicle components 330 interact with one or more ride surface components (e.g., the same or similar to those discussed throughout), such interaction may cause the ride vehicle 300 to spin, re-orient, or otherwise change or modify its behavior (e.g., slow the ride vehicle 300 down, speed the ride vehicle 300 up, etc.) as it travels along the water ride. As shown, a center of rotation 342 of the ride vehicle 300 may coincide generally with a center axis of a circular shape of the ride vehicle. Different centers of rotation may be obtained for ride vehicles have alternative shapes or configurations. In one embodiment, one or more of the ride vehicle components 330 may be shaped with a taper (e.g., a double taper or other shape or profile). For example, the ride vehicle components 330 may be radially tapered such that an outer circumferential edge is at a minimum height and a center of the ride vehicle component 330 is at a maximum height, as discussed in greater detail herein.

Figure 4:
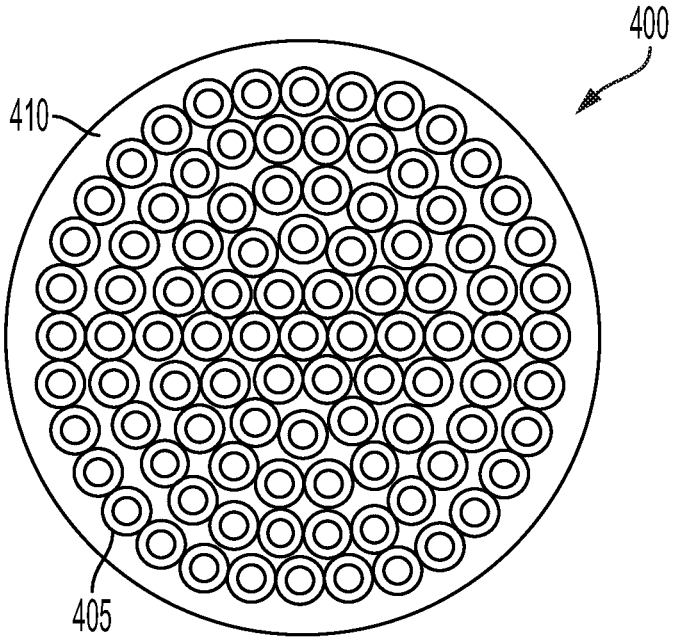
FIG. 4 illustrates a top view of a ride vehicle component embodying one or more principles of the disclosure, according to one exemplary embodiment of the invention.

FIG. 4 shows a top view of a ride vehicle component 400. The ride vehicle component 400 may include one or more features that are the same as or similar to those previously discussed, for example, to help effectuate orientation or behavior change for a ride vehicle connected with the ride vehicle component 400. The ride vehicle component 400 may include a plurality of protrusions 405 (e.g., bristles) that are configured to engage with a ride surface component (not shown) and thereby result in application of a frictional force to a ride vehicle for slowing down the ride vehicle (or some portion of the ride vehicle). As shown, the protrusions 405 may be frustoconical in shape. The smaller diameter end of the frustoconical shape may be configured to extend away from a bottom surface of the ride vehicle when the ride vehicle component 400 is connected with the ride vehicle. The protrusions 405 may be connected to a base 410.

Although the base 410 is shown in a circular configuration or shape, the base 410 may be any suitable shape or configuration for connecting in some manner to the ride vehicle (e.g., upon a bottom surface of the ride vehicle). The protrusions 405 may connected with the base 410 by any of a variety of possible manners (e.g., molding, screws, bolts, etc.) In one embodiment, the protrusions 405 may be molded together with the base 410. In one embodiment, the protrusions 405 and the base 410 may be made from a same (or different) material and/or be made of material(s) that is/are both rigid and allows for elastic deformation in the protrusions 405, such as, but not limited to, urethane, neoprene rubber, and/or any combination thereof. In one embodiment, the protrusions 405 may be approximately 0.75 inches in length, 0.5 inches in diameter at the base 56, and 0.25 inches in diameter at the smaller diameter end. In certain embodiments, different sizes, shapes, materials, etc. may be used for different protrusions 405 connected with the base 410.

Figure 5:
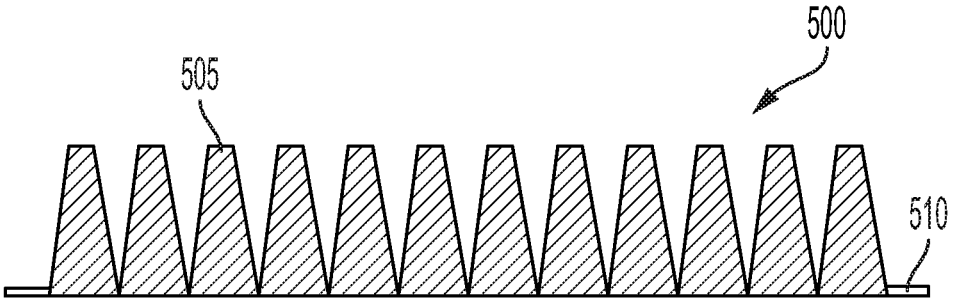
FIG. 5 illustrates a side view of a ride vehicle component embodying one or more principles of the disclosure, according to an exemplary embodiment of the invention.

FIG. 5 shows a side view of a ride vehicle component 500. The ride vehicle component 500 may include one or more features that are the same as or similar to those previously discussed, for example, the ride vehicle component 400 of FIG. 4. As shown a plurality of protrusions 505 are connected with a base 510. The protrusions 505 are each frustoconical in shape and have a same height. In an alternative embodiment, different shapes, heights, placement, and/or other configuration of the protrusions 505 may be used for different ride vehicle components and/or within a same ride vehicle component. In one embodiment, and as shown in FIG. 5, the protrusions 505 may all be substantially the same height and/or shape along the base 510. In an alternative embodiment, differing heights, shapes, profiles, or other configurations for the protrusions 505 along the base 510 may be used, for example, to aid in gradual application or force to be applied to a ride vehicle connected with the ride vehicle component 500.

Figure 6:
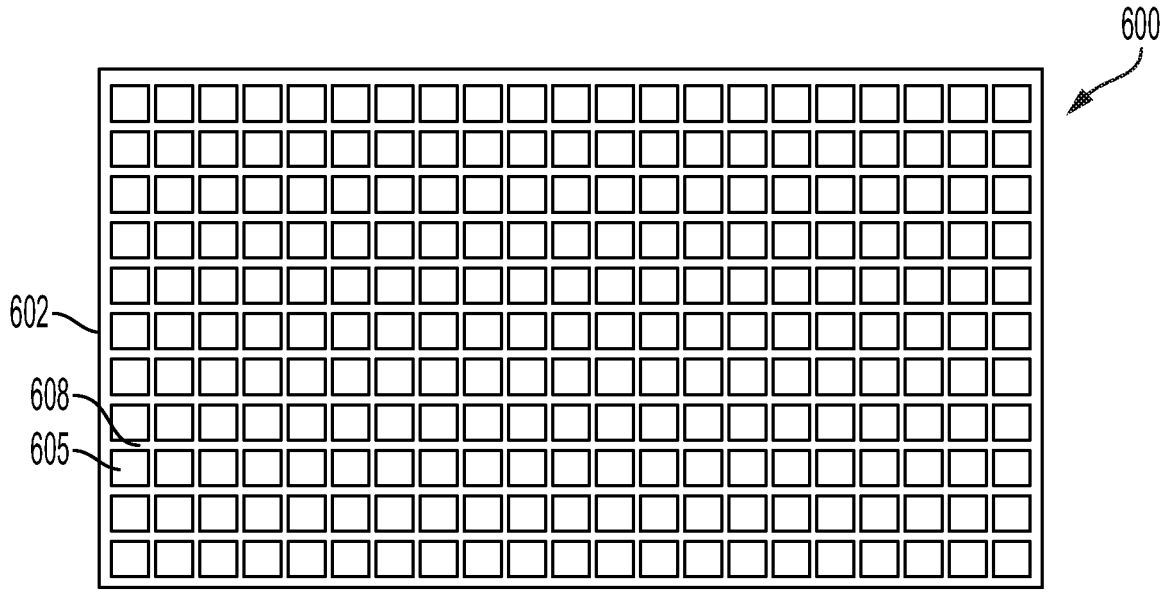
FIG. 6 illustrates a top view of a ride surface component embodying one or more principles of the disclosure, according to one exemplary embodiment of the invention.

FIG. 6 illustrates a top view of a ride surface component 600. The ride surface component 600 may include one or more features that are the same as or similar to those previously discussed, for example, to help effectuate orientation or behavior change for a ride vehicle that passes over the top or nearby to the ride surface component 600 (e.g., via one or more components connected with or associated with the ride vehicle that interact with the ride surface component 600). The ride surface component 600 may be made of a base material 602 that includes a plurality of depressions 605 formed between ridges 608 (e.g., made of the base material 602 and/or of a different material) with an edge at the top thereof. The ridges 608 may, in one embodiment, extend transversely to the ride path along which a ride vehicle is configured to travel as it moves along the ride surface. For example, such transverse positioning may provide contact with a corresponding ride vehicle component (e.g., having protrusions) associated with the ride vehicle. In one embodiment, the depressions 605 may be approximately 0.75 inches deep by 1.0 inch wide. In an alternative embodiment, any of a variety of shapes, dimensions, and/or configurations may be used for the depressions 605 and/or the ridges 608.

As shown, the depressions 605 may form substantially a checkerboard pattern with each one of the plurality of depression 605 having a square or rectangular cross-sectional shape and a square or rectangular profile. Contact between a component of a ride vehicle, such as the protrusions 405 of ride vehicle component 400 discussed for FIG.

4, and the ridges 608 of the ride surface component 600 as a ride vehicle travels over or near the ride surface component 600 may cause one side or portion of the ride vehicle to slow with respect to an opposite or other side of the ride vehicle, thereby causing the ride vehicle to spin (e.g., rotate about its center of rotation or axis). The ride surface component 600 may be molded in one piece from a material (e.g., a rigid material, flexible material, and/or a material that is both rigid and allows for elastic deformation of elements of the ride vehicle component (e.g., such as protrusions). In one embodiment, the ride surface component 600 and/or a corresponding ride vehicle component may be made of urethane, neoprene rubber, or any other desired material and/or combination of materials. The ride surface component 600 may be connected with a ride surface by any of a variety of connecting or coupling devices or manners, including but not limited to buttons, nails, snaps, screws, adhesives, welds, etc.

Figure 7:
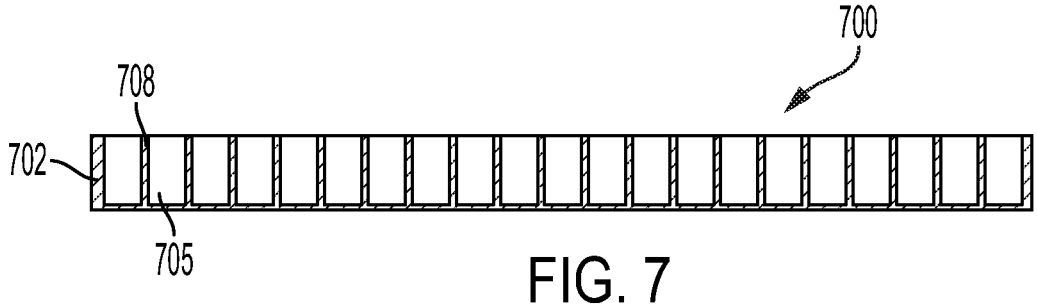
FIG. 7 illustrates a side view of a ride surface component embodying one or more principles of the disclosure, according to an exemplary embodiment of the invention.

FIG. 7 shows a side view of a ride surface component 700. The ride surface component 700 may include one or more features that are the same as or similar to those previously discussed, for example, the ride surface component 600 of FIG. 6. As shown, a base material 702 is formed and/or is connected with a plurality of depressions 705 separated by a plurality of ridges 708, the same or similar as previously discussed, for example, for FIG. 6.

Figure 8:
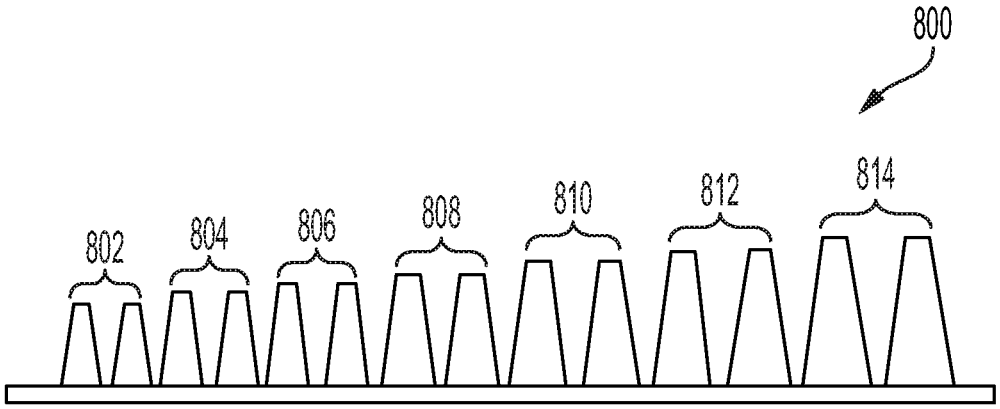
FIG. 8 illustrates a side view of a ride vehicle component embodying one or more principles of the disclosure, according to one exemplary embodiment of the invention.

FIG. 8 shows a side view of a ride vehicle component 800, for example, for use with a ride vehicle, as previously discussed. The ride vehicle component 800 may include features that are the same as or similar to those previously discussed, for example, a ride vehicle component configured to contact, engage, cooperate, or otherwise interact with another component (e.g., of a ride surface) for causing spinning, orientation, or other behavior changes of a ride vehicle based upon such contact, engagement, cooperation, or interaction. As shown, the ride vehicle component 800 may be shaped such that it includes a plurality of protrusions that define a tapered height or depth profile. The tapered height profile may be configured such that lower height protrusions 802 are configured to contact or engage with a ride surface component prior to contact by higher height protrusions (804, 806, 808, 810, 812, 814). In this way, the lower height protrusions 802 apply an initial lesser force to the ride vehicle via their contact with the ride surface component when compared to the force that would be applied by the higher height protrusions (804, 806, 808, 810, 812, 814). This application of an initial lesser force to initiate the redirection force (e.g., spinning or orientation of the ride vehicle) provides a lower "jolt" or abruptness to the user. For example, the hampered height profile may be radial in nature such that the lower height protrusions are located at an outer perimeter of a radial shape while higher height protrusions are located closer to a center of the radial shape.

Subsequently, the next height protrusion 804 would make contact or engage with the ride surface component and apply a force greater than the force applied by the lower height protrusion 802, but greater than the force that would be applied by the higher height protrusions (806, 808, 810, 812, 814). Accordingly, as the next higher height protrusions subsequently make contact with the ride surface component, a gradually increasing force is applied to the ride vehicle, resulting in a gradual reorientation or gradual change in behavior of the ride vehicle rather than an abrupt and/or jolting change experienced by the user. As shown in the embodiment of FIG. 8, the tapered height profile of the ride vehicle component 800 may be in the form of a step-wise and/or linear profile across the ride vehicle component 800, such that one end is at a minimum and the opposing end is at a maximum. Any of a variety of other profiles or configurations may be used in alternative embodiments, whether to result in a gradual application or force or an abrupt application of force, as desired.

Imposition of a gradual force to spin, orient, or re-direct a ride vehicle may be achieved through alternative embodiments. For example, any of a variety of other shapes for components associated with a ride vehicle and/or ride surface may be used. In one embodiment, a circular component may be used such that less surface of the component makes initial contact. Other shapes, such as wedges, angles, triangular, etc. may also or alternatively be used in varying embodiments. In still other embodiments, a component may have variable flexibility or give. For example, a component may include protrusions that became less flexible and/or become denser (e.g., more protrusions positioned closer together) along a length of the component to impose greater force in those areas of reduced flexibility and/or increased density. In still another embodiment, a thickness of one or more protrusions of a component may be increased in particular locations of the component to create a greater applied force. Any combination of such shapes, flexibility, thickness, and/or other manners may be used, alone, or in any combination, to create a ride vehicle component and/or ride surface component.

Figure 9:
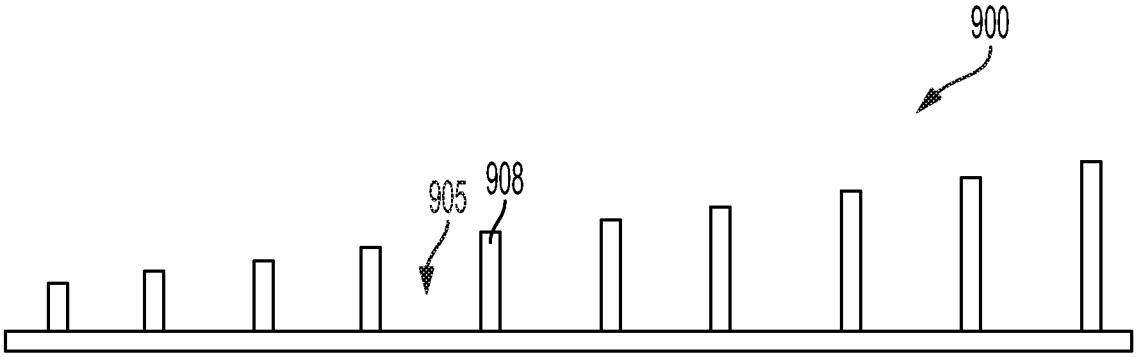
FIG. 9 illustrates a side view of a ride surface component embodying one or more principles of the disclosure, according to one exemplary embodiment of the invention.

FIG. 9 shows a side view of a ride surface component 900, for example, for use with a ride surface, as previously discussed. The ride surface component 900 may include features that are the same as or similar to those previously discussed, for example, a ride surface component configured to contact, engage, cooperate, or otherwise interact with another component (e.g., associated with a ride vehicle) for causing spinning, orientation, or other behavior changes of a ride vehicle based upon such contact, engagement, cooperation, or interaction. As shown, the ride surface component 900 may be shaped such that it includes a plurality of depressions 905 separated by a plurality of ridges 908 or other separating barriers (e.g., projections) that define a tapered height or depth profile. The tapered height profile may be configured such that certain ridges 908 extend higher than others and thereby may make greater contact with one or more elements or components associated with a ride vehicle, causing additional force to be exhibited upon the ride vehicle for changing its orientation or other behavior. As shown, the ridges 908 may have a linearly increasing height or depth. In an alternative embodiment, the ridges 908 may not increase or decrease in height or depth and/or may increase or decrease in height or depth 905 according to different profiles than specifically illustrated in FIG. 9.

Although particular ride surface components and/or ride vehicle components have been discussed and illustrated as preferred embodiments, any of a variety of possible shapes, configurations, and/or dispositions of such components may be used in alternative embodiments. For example, although the specific illustrations have been described as protrusions associated or connected with a ride vehicle for making contact with depressions and/or ridges associated or connected with a ride surface, opposite interaction may occur in alternative embodiments (e.g., depressions and/or ridges may be associated or connected with a ride vehicle while protrusions for engagement therewith may be associated or connected with a ride surface).

A ride surface and/or ride vehicle component may be any shaped protrusion and/or depression and/or surface and/or material that is used to engage with a ride vehicle component and change a direction, orientation, rotation, behavior, and/ or combinations thereof of the ride vehicle as it traverses an amusement ride. In one example, the ride surface component may be a textured surface (e.g., a mat having some pattern associated with its surface). In another example, the ride surface component may include a plurality of protrusions. The protrusions may be continuous and/or connected to define a plurality of depressions or may be individual protrusions.

Likewise, a ride vehicle component may be any shaped protrusion and/or depression and/or surface that is used to engage with a ride surface component and change a direction, orientation, rotation, behavior, and/or combinations thereof of the ride vehicle as it traverses an amusement ride. In one example, the ride vehicle component may be one or more protrusions, such as bristles.

In certain embodiments, the ride surface component may be coupled to the flume in different ways. In one example, the ride surface component may be coupled for permanent attachment to a portion of a water ride (e.g., the ride surface, flume, etc.). Permanent attachment may reduce potential decoupling of the ride surface component from the ride surface during extended use or engagement of the ride surface component with the ride vehicle component. The ride surface component may still be removable in a permanent attachment configuration, but the removable aspect may be intentionally removable, such as if the ride surface component is screwed onto the flume surface.

In an exemplary embodiment, the ride surface component is coupled to the ride surface to reduce the inadvertent removal of the ride surface component during use or upon engagement with the ride vehicle component. In one embodiment, a base of the ride surface component may be recessed into the flume surface. In one embodiment, a peripheral edge of the base may be covered by a flanged edge. The flanged edge may be integrated into the recess, into the ride surface, or created from a separate covering on the ride surface.

Similar to the accommodation of the ride surface component described herein, a ride vehicle component may be similarly protected and/or reinforced to reduce inadvertent detachment during use. The edges of the ride vehicle component may therefore be protected, such as positioned within a recess or covered to reduce direct contact or exposure with the ride surface component.

The above described embodiments are intended to illustrate the principles of the disclosure, but not to limit the scope of the disclosure. Various other embodiments and modifications to these preferred embodiments may be made by those skilled in the art without departing from the scope of the following claim. For example, the ride vehicle components and/or the ride surface components may be any shape that can catch on each other as the ride vehicle travels along a ride surface of a water ride. The ride vehicle components and/or ride surface components may comprise substantially any features which provide good contact to produce the desired manipulation of the ride vehicle (e.g., slowing of the ride vehicle at the contact point). In one embodiment, the ride surface components may extend substantially across the entire width of the flume to help engage with the ride vehicle components. In one embodiment, the ride surface components may extend across either side of the ride surface on either the inside or outside of a curve or in a straight section to cause the ride vehicle to change in orientation or behavior. In one embodiment, a bottom surface of the ride vehicle may include a high friction material and/or coating such as, but not limited to, neoprene rubber, urethane rubber, and/or any combination thereof. The material for the bottom surface of the ride vehicle may cause sufficient friction when it contacts a ride surface component to cause the ride vehicle to spin or slow without the use of ride vehicle components which project outwardly (e.g., downwardly) from the bottom surface of the ride vehicle.

Although a ride surface component and/or ride vehicle component are shown and described according to particular embodiments for the drawings discussed, any of a variety of alternative possible ride surface components and/or ride vehicle components may be used in alternative embodiments. For example, in one embodiment, a ride surface component may be an actuated material (e.g., fiberglass, metal, plastic, etc.) that is connected on or near the ride surface and configured to actuate (e.g., move) in a particular direction or in a particular fashion so as to physically bump and/or make contact with a ride vehicle in order to cause a change in orientation for the ride vehicle. Similarly, in another embodiment, a ride vehicle component may be an actuated material (e.g., fiberglass, metal, plastic, etc.) that is connected on or near the ride vehicle and configured to actuate (e.g., move) in a particular direction or in a particular fashion so as to physically bump and/or make contact with a ride surface or other structure of an amusement ride in order to cause a change in orientation for the ride vehicle. In still another embodiment, a component configured to provide a jet of fluid, such as pressurized fluid, for example, water, air, etc., may be configured to be enabled when a ride vehicle is detected and/or desired to have its orientation changed, such fluid providing a force upon the ride vehicle and/or a ride surface and thus causing the ride vehicle to change orientation. The detection of the ride vehicle within a particular area may be by any of a variety of possible detection mechanisms, including breaking of a laser, motion sensing, manual control, visual recognition, audio recognition, etc. In certain embodiments, the ride vehicle components and/or ride surface components may be used for alternative control of a ride vehicle rather than changing an orientation of the ride vehicle (e.g., speeding up a ride vehicle, slowing down a ride vehicle, etc.)

In another embodiment, a low or lower coefficient of friction material and/or coating (e.g., fabric, liquid, gel, etc.) may be applied or may make up a portion of the bottom and/or side of a ride vehicle, for example, at an opposite side or in areas adjacent to one or more ride vehicle components associated with the ride vehicle. Accordingly, for example, when the high or higher coefficient of friction material and/or coating engages with a component or feature of the ride surface for changing a behavior of the ride vehicle, a reduced amount of force need be applied due to the low or lower coefficient of friction material making up some or all of the remaining portions of the ride vehicle.

Although the disclosure has been described above with specific reference to various embodiments and examples, it should be understood that various additions, modifications, deletions and alterations may be made to such embodiments without departing from the spirit or scope of the disclosure. Accordingly, it is intended that all reasonably foreseeable additions, deletions, alterations and modifications be included within the scope of the disclosure as defined in the following claims. When used in this specification and claims, the terms "comprises" and "comprising" and variations thereof mean that the specified features, steps or integers are included. The terms are not to be interpreted to exclude the presence of other features, steps or components.

Although embodiments of this invention have been fully described with reference to the accompanying drawings, it is to be noted that various changes and modifications will become apparent to those skilled in the art. Such changes and modifications are to be understood as being included within the scope of embodiments of this invention as defined by the appended claims. Specifically, exemplary components are described herein. Any combination of these components may be used in any combination. For example, any component, feature, step or part may be integrated, separated, sub-divided, removed, duplicated, added, or used in any combination and remain within the scope of the present disclosure. Embodiments are exemplary only, and provide an illustrative combination of features, but are not limited thereto.

The invention claimed is:

1. An amusement ride comprising:

a ride surface with a bottom surface having a recess therein;

a ride surface component disposed at least partially within the recess of the ride surface; and a ride vehicle configured to travel along the ride surface, the ride vehicle having at least one protrusion extending therefrom, wherein the at least one protrusion of the ride vehicle is configured to make contact with the ride surface component causing a change in behavior of the ride vehicle.

2. The amusement ride of claim 1 wherein the ride surface component is a mat.

3. The amusement ride of claim 1 wherein the at least on protrusion is a bristle configured to make frictional contact with the ride surface component.

4. The amusement ride of claim 1 wherein the ride surface component includes a plurality of depressions separated by at least one ridge, the protrusion of the ride vehicle configured to be received by at least one of the plurality of depressions.

5. The amusement ride of claim 4 wherein the plurality of depressions form a checkerboard configuration.

6. The amusement ride attraction of claim 1 wherein the ride surface component is configured to be removable from the recess of the ride surface for replacement of the ride surface component.

7. The amusement ride attraction of claim 1 wherein the at least one protrusion of the ride vehicle is configured to be removable from the ride vehicle for replacement of the ride vehicle component.

8. The amusement ride of claim 1 further comprising a component for providing a source of water upon the ride surface.

9. The amusement ride of claim 8 wherein the ride surface component includes a pattern upon a surface of the ride surface component configured to aid in removal of water from the surface of the ride surface component.

10. The amusement ride of claim 1 wherein the change in behavior of the ride vehicle is a spinning of the ride vehicle.

11. The amusement ride of claim 1 wherein the change in behavior of the ride vehicle is a slowing of the speed of the ride vehicle.

12. An amusement ride comprising:

a ride surface having a recess therein;

a ride surface component connected with the ride surface and within the recess of the ride surface;

a ride vehicle configured to slide upon the ride surface and not extend into the recess of the ride surface; and a ride vehicle component connected with the ride vehicle and configured to extend at least partially into the recess of the ride surface, wherein a change in behavior of the ride vehicle is caused by a frictional force between the ride vehicle component and the ride surface component.

13. The amusement ride of claim 12 wherein the change in behavior of the ride vehicle is a rotation of the ride vehicle.

14. The amusement ride of claim 12 further comprising a second ride vehicle component connected with the ride vehicle and configured to extend further into the recess of the ride surface than the ride vehicle component.

15. The amusement ride of claim 12 wherein the change in behavior of the ride vehicle is a change in speed of the ride vehicle.

16. A ride vehicle for an amusement attraction, comprising:

a bottom surface; and a first protrusion coupled with the bottom surface, the first protrusion configured to make frictional contact with the amusement attraction; and a second protrusion coupled with the bottom surface, the second protrusion configured to make frictional contact with the amusement attraction, wherein the first protrusion has a longer length than the second protrusion.

17. The ride vehicle of claim 16 wherein the first protrusion and the second protrusion are positioned such that the second protrusion is configured to make frictional contact with the amusement attraction before the first protrusion is configured to make frictional contact with the amusement attraction.

* * * * *